US005811768A

United States Patent [19]

Choi et al.

[11] Patent Number: 5,811,768

[45] Date of Patent: Sep. 22, 1998

[54] APPARATUS FOR SENSING WHETHER FOOD DISPOSED ON A RAISABLE TRAY OF A MICROWAVE OVEN CONTACTS A HEATER

[75] Inventors: Won-Woo Choi; Seok-Weon Hong; Kwang-Seok Kang, all of Suwon, Rep. of Korea

[73] Assignee: Samsung Electronics Co., Ltd., Suwon, Rep. of Korea

[21] Appl. No.: 802,812

[22] Filed: Feb. 19, 1997

[30] Foreign Application Priority Data

Feb. 23, 1996 [KR] Rep. of Korea ..... 96-4360

[51] Int. Cl.[6] ..... H05B 6/68

[52] U.S. Cl. ..... 219/704; 219/685; 219/753; 219/762; 219/518; 99/325

[58] Field of Search ..... 219/753, 752, 219/705, 706, 704, 762, 763, 518, 685; 99/325

[56] References Cited

U.S. PATENT DOCUMENTS

| | | | |
|---|---|---|---|
| 4,596,914 | 6/1986 | Morino | 219/685 |
| 4,833,304 | 5/1989 | Ueda | 219/518 |
| 5,373,145 | 12/1994 | Endo et al. | 219/704 |
| 5,512,736 | 4/1996 | Kang et al. | 219/704 |

*Primary Examiner*—Philip H. Leung
*Attorney, Agent, or Firm*—Burns, Doane, Swecker & Mathis, L.L.P.

[57] ABSTRACT

A microwave oven has a cooking chamber in which a tray is provided for supporting food to be cooked. The tray is rotatable and can be raised and lowered. Cooking can be performed by microwaves and/or an electric resistance heater disposed in the cooking chamber. A sensor disposed in the cooking chamber detects a condition wherein food on the rising tray is at a height corresponding to that of the heater. In response to the sensing of such a condition the heater is turned off, a mechanism for raising the tray is also turned off, and a warning is emitted.

9 Claims, 3 Drawing Sheets

APPARATUS FOR SENSING WHETHER FOOD DISPOSED ON A RAISABLE TRAY OF A MICROWAVE OVEN CONTACTS A HEATER

FIELD OF THE INVENTION

The present invention generally relates to an apparatus for controlling the operation of a heater for a microwave oven. Relates to an apparatus for controlling the operation of a heater for a microwave oven by detecting the contact of the heater with cooking food when the tray on which the foodstuff is loaded is elevated.

BACKGROUND OF THE INVENTION

The description of a conventional microwave oven will now be given with reference to an accompanying drawing.

FIG. 3 shows a front cross-sectional view of a conventional microwave oven which includes a metallic cabinet 10, the cooking chamber 11; a magnetron (not shown) which radiates microwaves into the cooking chamber 11, a high-voltage transformer 13 which supplies power to the magnetron; a heater 17 mounted on the upper portion of the cooking chamber 11 which provides a supplementary cooking function; and a rotating tray 12 on which food is loaded. The tray is provided on the bottom of the cooking chamber 11 and can be elevated therein. A shaft 31 has its upper end connected with the bottom of the tray 12 and its lower end extending below the cooking chamber 11. An elevation guide member 34 is positioned under the shaft 31 in order to elevate the shaft 31. An elevation motor 33 laterally reciprocate the elevation guide member 34. A rotation motor 32 rotates the shaft 31 by means of a gear 32*a* engaged with the rotation motor 32. A weight sensing unit 35 is provided under the elevation guide member 34, which measures the weight of food on the tray 12.

The operation of the above conventional microwave oven will be now described with reference to FIG. 3.

A microwave oven cooks food by applying approximately 2,450 MHz microwaves, which are generated by its magnetron, to food contained in its metallic case.

When microwaves are applied to food, each of the food's molecules aligns its charge with its respective opposite charge in the electric field generated by the microwaves. Since the polarity of the electric field is, however, alternated 2,450,000,000 times per second according to the frequency of the microwaves, heat is generated by collisions between the molecules, resulting in the heating of the food.

In the recent past, an electric heater has been incorporated into the cooking chamber of the microwave oven so that convection heat and radiant heat generated by the electric heater are utilized to supplement the cooking process of the microwave oven.

As shown in FIG. 3, a conventional microwave oven can be divided into a cooking chamber 11 defined by the metallic cabinet 10 in which food is cooked, and an electrical component compartment 14 which accommodates the oven's electrical components.

The magnetron provided in the electrical component compartment 14 radiates microwaves to the cooking chamber 11 to cook food, and the high voltage transformer 13 powers the magnetron. Further, the heater 17 which supplements the cooking process with radiational heat is mounted on the upper portion of the cooking chamber 11.

The tray 12 on the bottom of the cooking chamber 11 is loaded with the food to be cooked, and rotates in a horizontal direction or moves up and down in the cooking chamber 11. Of the shaft 31 is connected with the bottom of the tray 12, and the lower end of the shaft 31 extends below the cooking chamber 11. The elevation guide member 34 having an inclined surface is installed under the shaft 31.

The elevation motor 33 reciprocates the elevation guide member 34 laterally to raise and lower the shaft 31, and the rotation motor 32 rotates the shaft 31 by means of a gear 32*a* engaged between the shaft 31 and the motor 32.

Normally, the heater 17 is not used, so the tray 12 remains in its lowered position.

However, if the user selects the grill mode, barbecue or pizza-baking mode, in which the operation of the heater 17 is needed, by pressing buttons on an operation panel (not illustrated), the heater 17 is turned on, the tray 12 is rotated and also elevated to a predetermined height.

Further, if the user selects one of the above modes, he may also place a grill on the tray 12, and then start the cooking process after loading food on the grill.

In the cooking process of the conventional microwave oven, if the tray is elevated after being loaded with a lot of food, the food could be burned by contacting the heater. This can also deform the food and contaminate the heater which would then require a troublesome cleaning process before reuse.

SUMMARY OF THE INVENTION

The object of the present invention is to provide an apparatus for controlling the operation of a heater for a microwave oven that will solve the above problems by detecting the contact of the heater with food in the microwave oven and then controlling the operation of the heater, when a cooking mode requiring the operation of the heater is selected.

In order to achieve this object, the microwave oven of the present invention, which cooks food using the microwaves generated by magnetron and the heat generated by a heater, includes a tray on which the food is placed, elevation means for elevating the tray, a position sensing unit for sensing the height of the food placed on the tray, and control means for controlling the heater and the elevating means by comparing the height of the food sensed by the position sensing unit with a reference height.

DETAILED DESCRIPTION OF THE PREFERRED EMBODIMENT

The preferred embodiment of the present invention will be described in detail with reference to the accompanying drawings.

Figure 1:
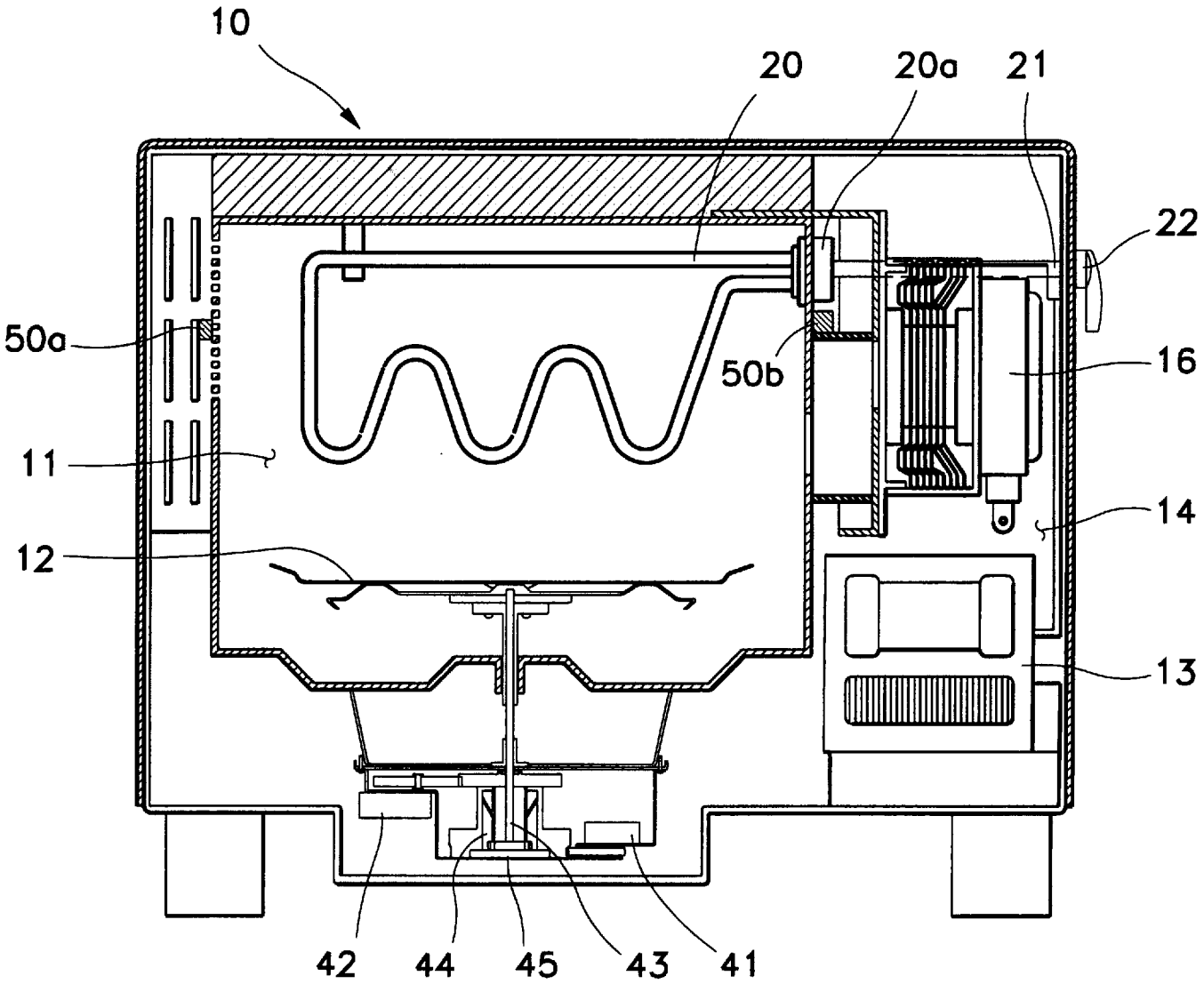
FIG. 1 is a front cross-sectional view of a microwave oven in accordance with the present invention.
Figure 2:
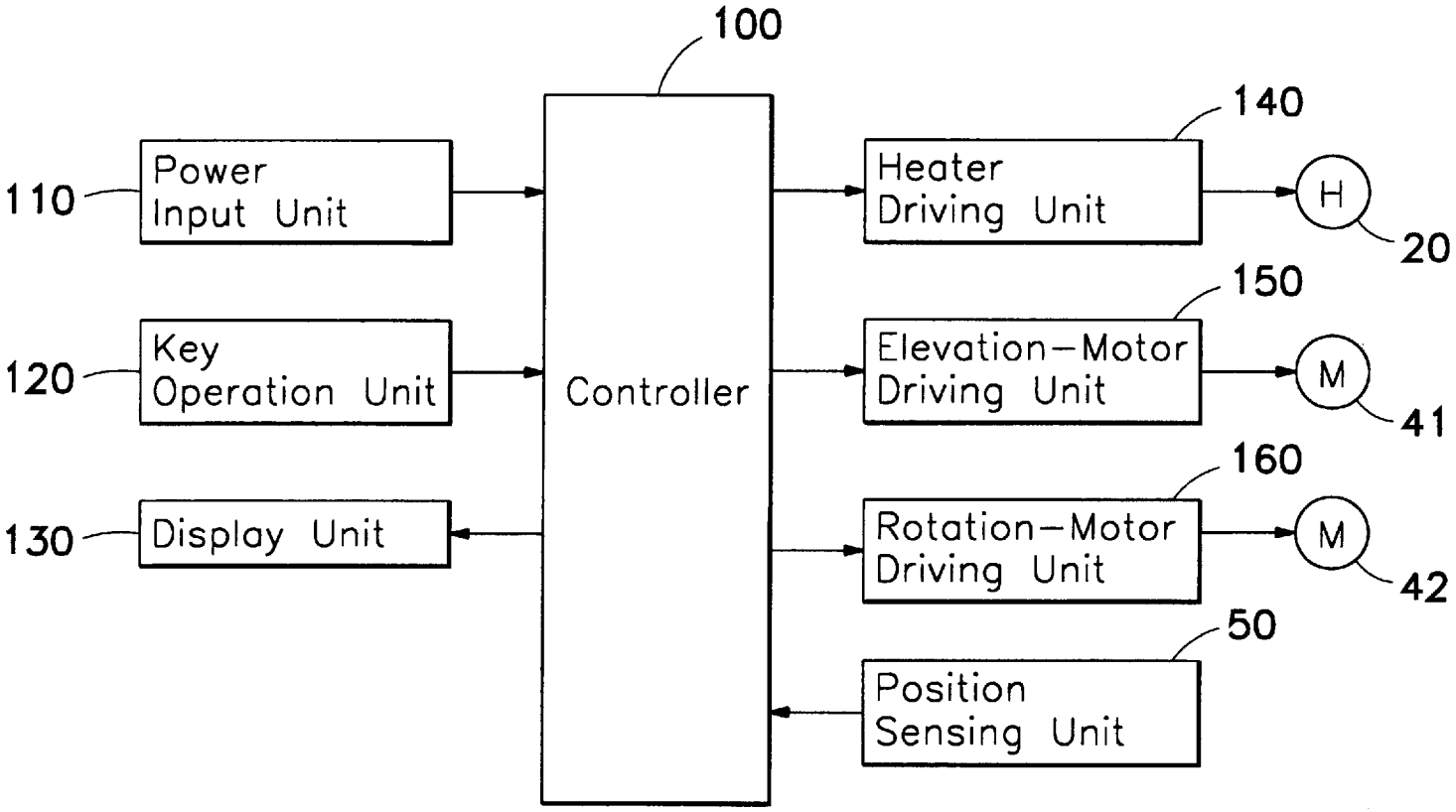
FIG. 2 is a block diagram of a control circuit for the microwave oven of FIG. 1.
Figure 3:
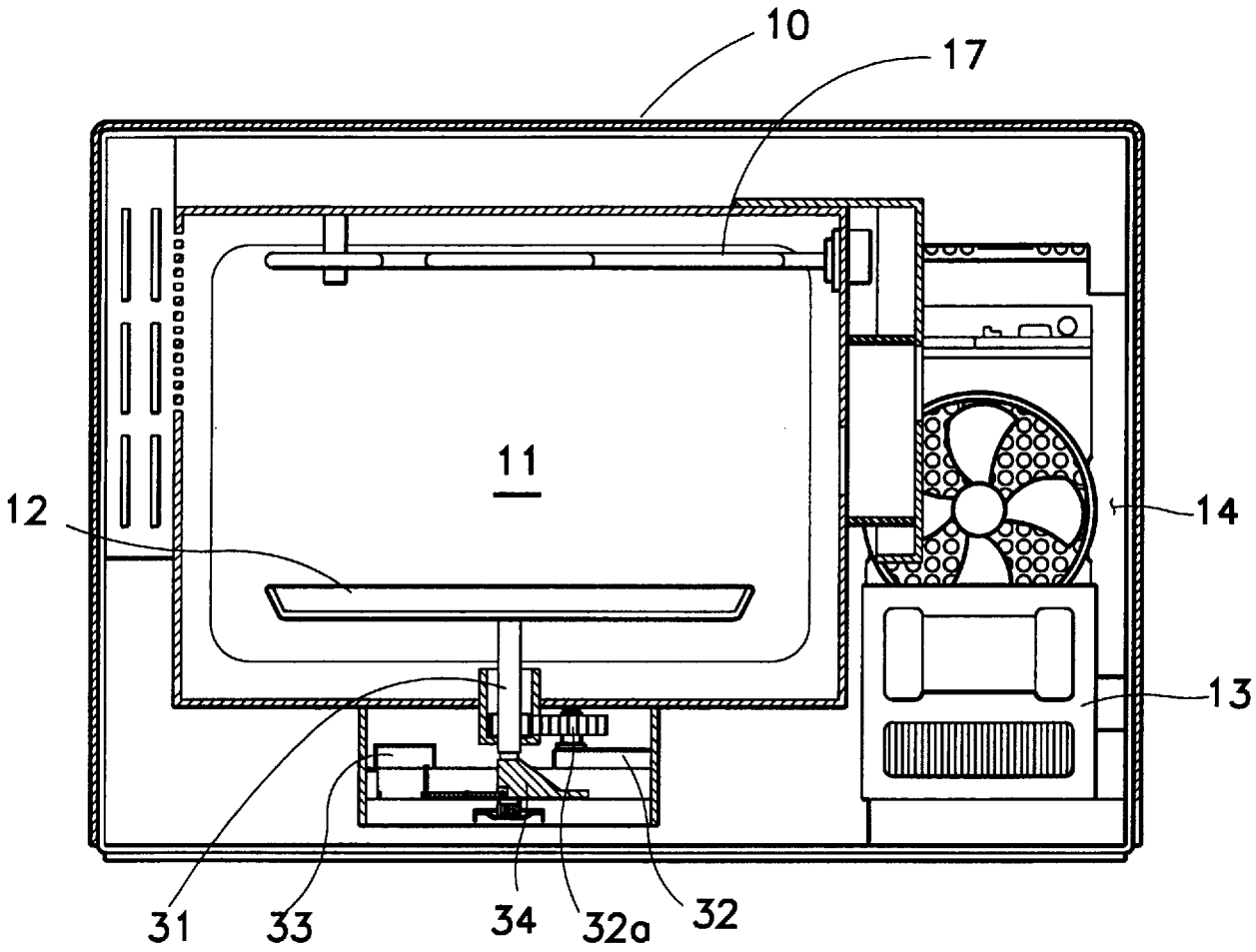
FIG. 3 is a front cross-sectional view of a microwave oven according to a prior art.

FIG. 1 is a front cross-sectional view of a microwave oven according to the embodiment of the present invention and FIG. 2 is a block diagram of a control circuit for the microwave oven of FIG. 1. The microwave oven of the present invention comprises a cooking chamber 11, a magnetron 16 provided in the electrical component compartment 14 which emits microwaves into the cooking chamber 11, a high-voltage transformer 13 which powers the magnetron 16, a heater 20 mounted on the upper portion of the cooking chamber which cooks food therein by radiant and convection heat, and a rotating tray 12 provided on the bottom of the cooking chamber 11 which receives food. A shaft 43 has its upper end connected with the bottom center of the tray 12 and its lower end extending below the cooking chamber 11. A rotation motor 42 delivers torque to a rotary gear 42A which in turn drives a gear 42B so as to rotate the shaft 43 and thus the tray 12, an elevation guide member 44 is positioned under the shaft 43 which elevates the shaft 43. An elevation motor 41 actuates the elevation guide member 44 so as to elevate the shaft 43. A weight sensing unit 45 is placed under the elevation guide member 44 and measures the weight of the food loaded on the tray 12 by sensing the pressure of the shaft 43 when the shaft 43 and the tray 12 are lowered to their lowest positions. A position sensing unit 50 senses the height of the food loaded on the tray 12, and a control means 100 compares the height of the food sensed by the position sensing unit 50 with a reference height and controls the operation of both of the heater 20 and the elevation motor 41.

Referring now to FIG. 2, the control circuit of the microwave oven of the present invention includes a controller 100 which controls the operation of the microwave oven from the start to the completion of cooking, a power input unit 110 which provides the controller 100 with electrical power, a key operation unit 120 used to select the desired cooking mode and duration, a display unit 130 which displays various messages and cooking conditions during operation, a heater driving unit 140 which controls the operation of the heater 20, an elevation motor driving unit 150 which controls the operation of the elevation motor that elevates the tray under the control of the controller 100, a rotation motor driving unit 160 which controls the operation of the rotation motor for rotating the tray, and a position sensing unit 50 for sensing as to whether or not the food loaded on the tray is contacting with the heater.

The operation of the inventive apparatus that controls the operation of the heater will be now described in detail.

As shown in FIG. 1, the microwave oven according to the embodiment of the present invention can be divided into the cooking chamber 11 defined by the metallic cabinet 10 in which food is cooked and the electrical component compartment 14 which accommodates the oven's electrical components.

The magnetron 16 provided in the electrical component compartment 14 radiates microwaves to the cooking chamber 11 to cook food, and the high voltage transformer 13 powers the magnetron 16.

The heater 20, which supplements the cooking process with radiational heat, is mounted on the upper portion of the cooking chamber 11. The tray 12 on the bottom of the cooking chamber 11 rotates and/or moves up and down with food loaded thereon.

An electrode 20*a* which supplies power, is connected at one end to the heater 20, and the other end, protruding into the electrical component compartment 14, is connected to a horizontal shaft 21 which extends outside the cabinet 10. An external handle 22 inserted into the horizontal shaft 21 is used for pivoting the heater 20.

The shaft vertically inserted into the cooking chamber 11, the upper end of which is connected with the bottom center of the tray 12 and the lower end of which extends below the cooking chamber 11. Rotation motor 42 delivers driving force to the two rotary gears, one of which 42B is connected to the shaft 43 and the other 42A to the rotation motor, to rotate the tray 12 by rotating the shaft 43.

When the elevation motor 41 activates the elevation guide member 44, the member 44 delivers driving force to the shaft 43 to elevate the shaft 43 and thereby the tray.

The weight sensing unit 45 is installed under the elevation guide member 44 and measures the weight of the food loaded on the tray 12 by sensing the pressure applied to itself by the shaft 43 when the shaft 43 and the tray 12 are lowered to their lowest position by the elevation means.

The weight sensing unit 45 compares the output signal frequency during its initial state with the output signal frequency when the shaft 43 has been lowered to its lowest position, and calculates the difference between them to determine the weight of the food on the tray 12.

Referring to FIG. 2, the controller 100 controls the operation of the microwave oven from the start to the completion of cooking, and the power input unit 110 supplies the controller 100 with electric power. The user inputs the desired cooking mode and duration, to the microwave oven by using the key operation unit 120. The display unit 130 displays the current state of the oven and the cooking mode so that the user may check the progress of the procedure.

The heater driving unit 140 controls the operation of the heater 20 and the elevation motor driving unit 150 controls the operation of the elevation motor 41 based on a control signal sent from the controller 100.

The rotation motor driving unit 160 controls the operation of the rotation motor 42, and the position sensing unit 50 detects whether or not the heater is contacting the food on the tray.

The position sensing unit 50 comprises two photosensors oppositely positioned on the right and left inside walls of the cooking chamber, wherein the light receiving photosensor 50*b* detects a light signal transmitted from the light emitting photosensor 50*a*, thereby detecting the position of the food in the cooking chamber 11. The photosensors are positioned slightly below the level of the heater in order to report the presence of food loaded on the tray that would contact the heater.

If the food on the tray 12 is piled up to the height where it would contact the heater 20, when the tray is raised to a desired height the light receiving photosensor 50*b* does not receive the light signal from the light emitting photosensor 50*a*, because the signal is obstructed by the food. Thus, the controller 100 determines that the heater 20 is contacting the food.

Referring again to FIG. 1 and FIG. 2, the method of sensing the contact of the heater 20 with the food using the position sensing unit 50 will be now described in detail.

First, after applying electric power to the microwave oven, the user selects a desired cooking mode. At this time, if the cooking mode requires the operation of the heater 20, the position sensing unit 50 is actuated and the heater 20 is turned on.

The tray 12 starts to rotate once the cooking process begins. After a predetermined time has elapsed after the tray 12 has begun to rotate, the elevating motor 41 is operated to elevate the tray 12 to a predetermined height.

At this time, the position sensing unit 50 determines if the heater is contacting the food loaded on the tray 12. If the light receiving photosensor 50*b* does not receive the light signal from the light emitting photosensor 50*a* due to the presence of the food, the controller 100 determines that the food is piled on the tray to the point that it contacts the heater 20.

The controller 100 then turns off both the heater driving unit 140 and the elevation motor driving unit 150 and then issues a message through the display unit 130 which informs the user of the situation. The user can then restart the cooking process after he or she changes the quantity or position of the food.

According to the present invention, if any cooking mode is selected which requires the operation of a heater, the heater will be turned off if it is in contact with the food and the user will then be informed. Therefore, the present invention can reduce or eliminate troubles due to the failure of cooking or the contamination of the heater.

What is claimed is:

1. A microwave oven, comprising:

a cooking chamber;

a magnetron for supplying microwaves to the cooking chamber;

an electric resistance heater disposed at an upper portion of the cooking chamber;

a tray in the cooking chamber for supporting food;

an elevator mechanism for elevating and lowering the tray;

a position sensor for sensing an elevation of food disposed on the tray, the position sensor comprising a photosensor including a light emitter mounted on an upstanding wall of the cooking chamber, and a light receiver mounted on an opposing wall of the cooking chamber; and a control mechanism connected to the heater, elevator mechanism and position sensor for controlling the heater and elevator mechanism in accordance with the sensed elevation.

2. The microwave oven according to claim 1 wherein the control mechanism is operable to turn off the elevator mechanism when the food is at a predetermined elevation.

3. The microwave oven according to claim 2 wherein the control mechanism is further operable to turn off the heater when the food is at the predetermined elevation.

4. The microwave oven according the claim 1 wherein the position sensor is situated at the same elevation as the heater.

5. The microwave oven according to claim 1 wherein the control mechanism is operable to display a message to a user when the food is at the predetermined elevation.

6. The microwave oven according to claim 1 further including a rotary mechanism for rotating the tray about a vertical axis as the tray is being elevated.

7. A method of operating a microwave oven comprising the steps of:

A) actuating an electrical resistance heater disposed at an upper portion of a cooking chamber of the oven;

B) elevating a tray in the cooking chamber on which food is disposed;

C) directing a light of a photosensor from a vertical wall of the cooking chamber toward a light receiver disposed on an opposing vertical wall of the cooking chamber for detecting the presence of food on the tray being elevated; and D) terminating step B in response to detecting the presence of food at substantially the elevation of the heater.

8. The method according to claim 7 wherein step C further includes deactivating the heater.

9. The method according to claim 7, wherein step B comprises rotating the tray about a vertical axis as it is being elevated.

* * * * *